US005368475A

United States Patent [19]

Suppiah et al.

[11] Patent Number: 5,368,475

[45] Date of Patent: Nov. 29, 1994

[54] CATALYST STRUCTURES AND BURNERS FOR HEAT PRODUCING DEVICES

[75] Inventors: Sellathurai Suppiah, Deep River; Deborah L. Burns, Chalk River; Karen G. Irving; Christopher R. Aelick, both of Penbrooke, all of Canada

[73] Assignee: Atomic Energy of Canada Limited, Ottawa, Canada

[21] Appl. No.: 848,670

[22] Filed: Mar. 9, 1992

Related U.S. Application Data

[63] Continuation-in-part of Ser. No. 403,290, Sep. 7, 1989, Pat. No. 5,094,611.

[51] Int. Cl.[5] ..... F23Q 11/00

[52] U.S. Cl. ..... 431/268; 431/329; 126/414

[58] Field of Search ..... 431/7, 263, 326, 328, 431/329, 100, 347, 147, 350, 351, 354, 352, 353; 126/409, 414

[56] References Cited

U.S. PATENT DOCUMENTS

| | | | |
|---|---|---|---|
| 614,557 | 11/1898 | Killing | 432/268 |
| 751,856 | 2/1904 | Hughes | 431/100 |
| 757,218 | 4/1904 | Oberlaender | 431/268 |
| 2,336,816 | 12/1943 | Thompson | 431/100 |
| 3,087,484 | 4/1963 | Eddy | 432/329 |
| 3,204,683 | 9/1965 | Ruff et al. | 431/347 |
| 3,269,449 | 8/1966 | Witten, Jr. | 431/328 |
| 3,277,886 | 10/1966 | Ryals et al. | 431/329 |
| 3,563,251 | 2/1971 | Jorgensen | 132/33 |
| 3,975,140 | 8/1976 | Placek | 431/329 |
| 4,248,208 | 2/1981 | Diederich | 126/409 |
| 4,382,448 | 5/1983 | Tittert | 132/33 R |
| 4,416,298 | 11/1983 | Berghammer et al. | 132/33 R |
| 4,502,465 | 3/1985 | Yoshinaga et al. | 126/409 |
| 4,524,094 | 6/1985 | Lindstrom et al. | 428/36 |
| 4,539,974 | 9/1985 | Tittert | 126/409 |
| 4,543,968 | 10/1985 | Fukunaga et al. | 132/33 R |
| 4,552,124 | 11/1985 | Nakajima | 126/413 |
| 4,599,066 | 7/1986 | Granberg | 431/329 |
| 4,631,024 | 12/1986 | Shibata et al. | 431/268 |
| 4,641,632 | 2/1987 | Nakajima | 126/413 |
| 5,026,273 | 6/1991 | Cornelison | 431/329 X |
| 5,094,611 | 3/1992 | Suppiah et al. | 431/268 |

FOREIGN PATENT DOCUMENTS

| | | | |
|---|---|---|---|
| 920468 | 2/1973 | Canada | 132/14 |
| 1024847 | 1/1978 | Canada | 132/16 |
| 1133782 | 10/1982 | Canada | A45D 1/04 |
| 1133783 | 10/1982 | Canada | A45D 1/04 |
| 1144446 | 4/1983 | Canada | A45D 2/36 |
| 1144447 | 4/1983 | Canada | A45D 2/36 |
| 1159869 | 1/1984 | Canada | A45D 1/02 |
| 1189500 | 6/1985 | Canada | B01J 35/06 |
| 1215270 | 12/1986 | Canada | B23K 3/02 |
| 870772 | 3/1942 | France | 15/1 |
| 50-67294 | 6/1975 | Japan | B01J 23/40 |
| 57-47118 | 3/1982 | Japan | F23D 13/18 |
| 61-164646 | 7/1986 | Japan | B01J 32/00 |
| 62-79846 | 4/1987 | Japan | B01J 23/40 |
| 2167546A | 5/1986 | United Kingdom | F24H 3/04 |
| 2170705A | 8/1986 | United Kingdom | A45D 20/00 |

*Primary Examiner*—Carl D. Price
*Attorney, Agent, or Firm*—Nixon & Vanderhye

[57] ABSTRACT

A catalytic burner for oxidizing gaseous fuel in a catalytic combustion device having a gaseous fuel discharge tube, the burner comprises a tubular catalyst defining a catalytic combustion chamber and having an inlet opening at one end thereof for admitting gaseous fuel into the chamber, an outlet opening at the other end thereof for discharging products of combustion from the chamber, and a support for mounting the catalyst in coaxial relation on the discharge tube; and a gas distributor disposed within the inlet end of the catalyst proximate to but spaced from the discharge tube for uniformly distributing across the chamber gaseous fuel introduced into the chamber through the inlet opening.

12 Claims, 4 Drawing Sheets

CATALYST STRUCTURES AND BURNERS FOR HEAT PRODUCING DEVICES

This application is a continuation in part of application Ser. No. 07/403,290, filed Sep. 7, 1989, now U.S. Pat. No. 5,094,611, issued Mar. 10, 1992.

The present invention relates to catalytic burner for use in heat producing devices such as curling irons, soldering irons, camp heaters and the like.

BACKGROUND OF THE INVENTION

It is well known to use catalyst burners as a source of flameless and cordless heat in heat producing devices such as curling irons, soldering irons and the like. Catalytic burners include a catalytic material which oxidizes gaseous fuels, such as butane or propane, in the presence of air to produce the desired heat in such devices. In normal operation, fuel is discharged from a self-contained source of liquefied fuel through a nozzle, which converts the liquefied fuel to gas, mixed with air or other source of oxygen and delivered to a catalytic combustion chamber in which the catalytic burner is located.

The temperature to which the catalyst must be heated to initiate and sustain catalytic oxidation depends on the oxidation reaction itself and the activity of the catalyst. Some reactions can be initiated without any external heating at all. For example, the oxidation of methanol can be initiated at ambient or below ambient temperatures simply by exposing an active catalyst to mixtures of methanol and air. However, the oxidation of other fuels, such as butane and propane, require the temperature of the catalyst to be raised to a higher temperature, called the light-off temperature, before the oxidation reaction will occur. To that end, various methods, including frictional and electrical heating, have been developed to pre-heat the burner to the light-off temperature. A common method is to cause an explosion of a mixture of the combustible gas and oxygen (air) in or near the catalytic combustion chamber. In some cases, the heat produced by the explosion is sufficient to initiate the catalytic reaction. In other instances, the quantity of heat developed by explosion is insufficient, resulting in unsatisfactory operation of the device.

Conditions suitable for normal catalytic reactions are often less than ideal for initiating the reaction. A fully heated burner does not require particularly high gas flow rates or gas flow to impinge directly on the burner. The natural processes of convection and conduction are sufficient to direct the flow to the burner. While it is desirable to initiate an explosion within the combustion chamber, it is usually not physically possible to do so. Thus, the explosion must be initiated at a relatively remote location which results in less efficient heating and, frequently, less than satisfactory operation. Common deficiencies of known catalytic burners are lack of reliability in quickly reaching light-off temperature and incomplete oxidation during startup, resulting in unburned gases leaving the combustion chamber of the burner. In addition to these difficulties, known catalytic burners of the aforementioned type tend to be difficult to manufacture and assemble, physically unstable in the sense that they have a tendency to deform or break down, and may be subject to relatively low maximum operating temperatures.

SUMMARY OF THE INVENTION

The present invention seeks to provide a catalytic burner structure which enhances both normal catalytic reactions and the initiation of such reactions. More specifically, the burner structure is such as to more quickly commence catalytic oxidation in the presence of an explosion and, if the heat of the explosion is insufficient to commence this process, to form within the combustion chamber a transient flame that heats at least a portion of the catalyst structure and then self-extinguishes after catalytic oxidation begins.

In accordance with one aspect of the invention, there is provided a catalytic combustion element for use in a catalytic combustion device, the element comprising a self-supporting tubular body formed of a fine mesh screen having a coating of catalytic material applied thereto and having a passage extending therethrough defining a catalytic combustion chamber, an inlet opening at one end thereof for receiving a gaseous fuel and an outlet opening at the other end thereof for discharging products of combustion from the chamber.

In accordance with a further aspect of the invention, there is provided a distributing means for producing a multiplicity of small axial jets of gaseous fuel at relatively high velocity in the chamber whereby to facilitate the formation of a stable transient flame within the chamber while the temperature of the catalytic material is below the temperature required by the material to sustain catalytic oxidation.

BRIEF DESCRIPTION OF THE DRAWINGS

These and other features of the invention will become more apparent from the following description in which reference is made to the appended drawings wherein.

DESCRIPTION OF PREFERRED EMBODIMENT

Figure 1:
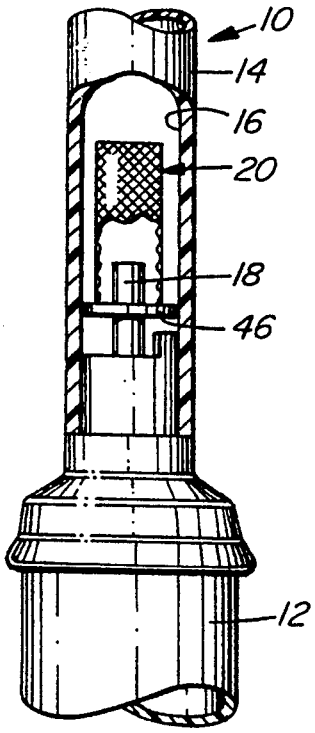
FIG. 1 is broken elevational view, partially in cross-section, of a curling iron application of a catalytic combustion device diagrammatically illustrating thereon a catalytic burner according to an embodiment of the present invention.

With reference to FIG. 1 and by way of background, there is illustrated catalytic combustion device in the form of a curling iron 10 having a handle 12 and a barrel 14 coaxially secured to the handle and defining a heating chamber 16. Handle 12 is hollow and is adapted to either form a pressure vessel or contain a pressure vessel which holds a supply of a liquified fuel such as butane or propane. As is well known in the art and not described in detail herein, liquified fuel is released from the pressure vessel, converted to its gaseous phase, mixed with air and delivered to gaseous fuel discharge tube 18. The gaseous fuel emitted from tube 18 enters the interior of a catalytic element 20 of the present invention in which flameless catalytic oxidation occurs which in turn heats the air surrounding element 20. A temperature control mechanism, not shown, operates to control the gaseous flow rate and hence the temperature within the heating chamber.

In most devices of the aforementioned type, it is necessary to initially heat the catalytic element to its light-off temperature, the temperature at which catalytic oxidation commences and is maintained. To that end there is provided ignition means, not shown, in the form of a flint wheel or an electrode system having a piezoelectric crystal to cause a spark within the heating chamber which in turn causes an explosion of the gaseous fuel. In some devices, the ignition means is located downstream of the discharge tube while, in other devices, it is located upstream and to the outside of the gas discharge tube. When the catalyst is very active, the heat of the explosion itself may be sufficient to heat the catalyst module to its light-off temperature and therefore it is not necessary to cause a flame in the heating and/or combustion chambers. However, with relatively inactive catalysts, i.e. catalysts with higher light-off temperatures, it is necessary to initiate a flame in the combustion chamber.

The present invention provides a catalyst module or burner which facilitates the formation of a flame, when required on initial startup, which is operable to heat the burner to a higher level than can otherwise be achieved with conventional burners, and reduces the time normally required for the catalytic element to reach its light-off temperature.

Figure 2:
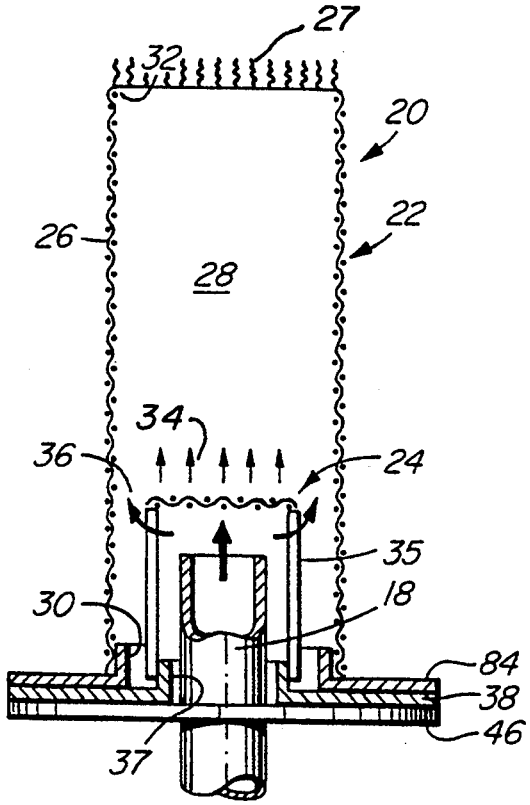
FIG. 2 is an enlarged cross-sectional view of a catalytic burner according to a preferred embodiment of the present invention.

With reference to FIG. 2, the catalyst module, generally designated by reference numeral 20, includes a catalytic combustion element 22 and a gas distributing element 24. Catalytic combustion element 22 generally comprises a self-supporting tubular or cylindrical body 26 formed of a fine mesh screen having a coating of catalytic material applied thereto. Body 26 defines a catalytic combustion chamber 28 and includes an inlet opening 30 at one end for receiving a gaseous fuel and an outlet opening 32 for discharging products of combustion from the combustion chamber. As will be noted in the following description and in the drawings, if the site of the spark produced by the ignition means is at the end of the heating chamber remote from gas discharge tube, then the outlet opening is preferably located at the end of body 26 remote from the inlet opening so that, on startup, gas will flow axially through the body 26 and the heating chamber to the site of the spark. In this embodiment, body 26 is formed with portions having a greater length of exposed edge than other portions of said body whereby these portions tend to heat more quickly to a higher temperature than other portions of the body when exposed to an igniting flame. On the other hand, if the site of the spark is at the other end of the heating chamber, upstream of the discharge opening of the discharge tube, the outlet opening is preferably located adjacent the inlet end of body 26 so as to again allow gas to reach the site of the spark as quickly as possible.

In order to minimize the light-off temperature and maximize catalytic activity, the catalyst module will preferably have the characteristics described hereinbelow. With regard to tubular body 26, its primary function is that of a carrier for the catalytic material. As explained below, however, the carrier also serves a secondary function of absorbing and conducting heat to the catalytic material during initial ignition. The carrier should be as rigid as possible to minimize deformation under normal handling, it being understood that deformation of the carrier could cause the coating to crack and fall off of the body, thereby adversely affecting the performance of the catalyst module. In order to provide both strength and heat transfer capabilities, the carrier is preferably formed of a metallic material. While the present invention contemplates coated solid or perforated metallic or other such self-supporting bodies, a fine mesh, plain stainless steel screen is preferred because of the ease and minimum expense by which it may be manufactured and because the screen, which preferably has a U.S. mesh screen size in the range of 100 to 325, is formed of tightly woven wires which provide a relatively large geometric surface area as compared with a solid or perforated metallic body. This property maximizes the bond or adherence between the catalyst material, particularly, a catalyst support described below, and the carrier. Clearly, non-metallic carriers will tend to be more subject to deformation, which adversely affects performance. The screen also allows the structure to remain relatively flexible and shapeable with heavy loadings (20% alumina on a coated screen) because of the many binding sites provided by the interwoven wires. This is not possible with solid bodies.

The coating applied to the carrier, tubular body 26, comprises a catalyst support which is applied to the carrier and a catalyst applied to the catalyst support. Platinum is the preferred catalyst; however, any other suitable catalytic material may be provided. The catalyst support is preferably and desirably a porous material such as alumina or silica. These porous substances provide a surface area which can be many orders of magnitude greater than the external surface area provided by the geometry of the structure. For example, porous alumina spheres have a surface area of several hundred square meters per gram although their external surface area may only be a fraction of a square meter. This allows the device to carry a much heavier loading of catalyst than would otherwise be possible and, therefore, enhances the performance of the device.

The outlet openings of the tube 26 are formed by cutting through the coated screen. This exposes the ends 27 of the metallic wires so that, on ignition of the fuel, the ends of the wires absorb heat and conduct it along their lengths. The heat is then transferred to the catalyst support and then to the catalyst on the support. In this manner, it is believed that the catalyst will achieve the light off temperature more quickly than an arrangement in which the ends of the wires are coated. To optimize this effect, the outlet openings may be formed by cutting the screen in a zig-zag pattern, as indicated later. The prior art suggests unravelling the ends of the tube. This is undesirable. Firstly, if the wires are unravelled after the tube is coated, there is the great danger that the coating will break away from the wires and severely adversely affect performance. Even if the wires are unravelled before the coating, the unravelled ends may not have sufficient strength to withstand deformation caused by normal handling during installation and the like. In either case, the underlying wires are not exposed to absorb the initial heat caused by the explosion within the combustion area.

Gas distributor 24 is preferably in the form of a fine mesh, stainless steel screen disposed within the chamber 28 and serves to distribute or redirect within the chamber gaseous fuel introduced into the inlet opening. The distributor is dimensioned to provide an annular clearance 36 between the inner surface of body 26 and the circumference of the distributor so that gaseous fuel is urged radially outwardly into intimate contact with the catalyst and then axially, toward the remote end of the body. The distributor not only helps to distribute the gas across the catalytic combustion element cross-section but also increases the velocity of the gas across this cross-section. This creates the following effect. It helps to produce a concentrated explosion at the sites of the outlet of the catalyst combustion element where the critical portions of the catalyst combustion element, such as exposed ends of the stainless steel wires or catalyst tips, are located. During operation, the presence of the distributor is capable to draw the explosion created by a spark outside the catalyst combustion element into the element. This helps to initiate the operation of the catalyst. Thus, the distributor controls the location of explosion. In embodiments in which the outlet opening is substantially open and located at the opposite end of body 26 from the inlet opening, the distributor is preferably positioned relatively close to the outlet of the gas discharge tube so as to produce a multiplicity of small axial jets 34 of gaseous fuel at relatively high velocity in the chamber to facilitate the formation of a stable transient flame while the temperature of the catalytic material is below the temperature required by the material to sustain catalytic oxidation. In embodiments in which the upper end of body 26 is substantially closed and/or the outlet opening is located adjacent the inlet opening, the catalyst will tend to reach its light-off temperature much more quickly because of intimate contact between the gaseous fuel and body 26 and therefore a transient flame may not be required or occur. In these embodiments, the distributor is spaced at a greater distance from the outlet of the gas discharge tube and primarily serves to urge the inflowing gas radially outwardly within the chamber into more intimate contact with the inner surface of tube 26.

While the preferred form of the distributor 24 is a fine mesh, stainless steel screen, the invention contemplates a plain disk formed with axial holes therein if required. The size of the openings in the distributor is chosen to facilitate the formation of a flame if the catalytic oxidation is not initiated by the explosion. Generally, a 325 mesh screen is adequate to produce the flame. Depending on the gas flow rate, a wide range of mesh size may be used as the distributor screen. 100, 200 and 325 mesh screens are quite adequate for the flow rates encountered in devices of the above described type.

Figure 4:
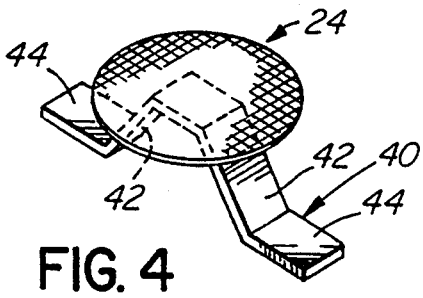
FIGS. 4 and 5 are alternative embodiments of a fuel distributing means according to the present invention.
Figure 5:
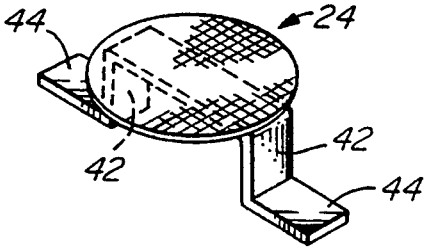

In the embodiment of FIG. 2, distributor screen 24 is circular in plan view, concentrically disposed within element 22 and of slightly smaller diameter than the inner diameter of the catalyst element, thus providing annular space 36 between the edge of the screen and the catalyst element. The disc may be secured in place in any suitable manner. In FIG. 2, the distributor is secured to one end of a coarse screen 35 whose other end is secured to the tubular neck portion 37 of an annular flange 38 which seats on retainer 46. As shown in FIG. 4, a thin stainless steel strip 40 may be secured to the underside of screen 24 and formed with a pair of divergent legs 42 terminating in planar feet 44. Feet 44 may be secured to retainer 46 (FIG. 1) secured to discharge tube 18. The construction illustrated in FIG. 5 is similar to that of FIG. 4 except that the legs extend from the edges of the screen. It will be seen that these mounting means permit unobstructed radial flow of fluid released from the gas discharge tube.

Figure 3:
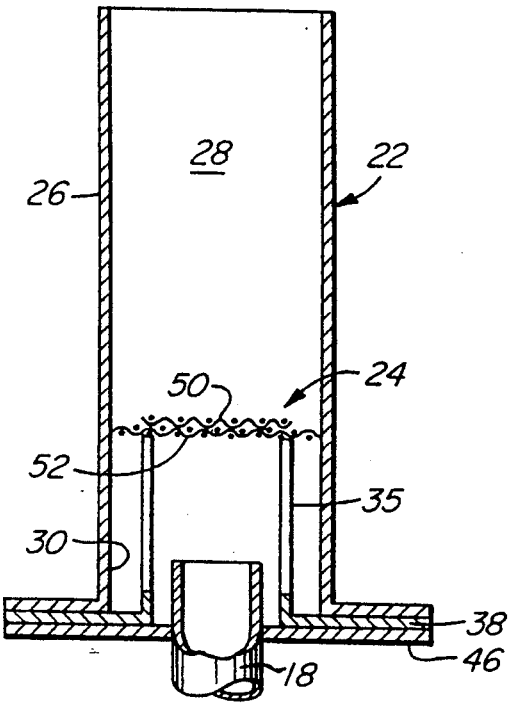
FIG. 3 is an enlarged cross-sectional view, similar to FIG. 2, of an alternative embodiment of the catalytic burner of the present invention wherein a gaseous fuel distributing means comprises a pair of fine mesh screen secured together in face-to-face relation.

The distributor embodiment shown in FIG. 3 has been found to perform particularly well. In this embodiment, two layers of fine mesh screens 50 and 52 are spotwelded together to provide greater resistance to gas flow in the central region of the chamber. Screen 52 extends across the entire cross-section of chamber 28, as shown. The cross-sectional area for the flow of gases through the screen is lower compared to a single screen, resulting in increased gas velocity through the distributor screen. The increased velocity facilitates the formation of a flame on the screen. It has been found that this embodiment performs better than the single screen distributor when the spark for the explosion was generated below the retainer 46. It will be understood that the same effect may be achieved by the use of one single layer of the appropriate mesh, but the above design may be more cost effective.

It is preferred that the distributor screen is coated with catalyst, for example, first coated with alumina and then with platinum, so that the distributor not only helps to distribute the gas it also helps to initiate the catalytic reaction because of the large amount of heat produced on it at the moment of the explosion.

Turning now to the catalyst element, it has been found that, in general, catalyst modules made from very light weight screen, for example 325 mesh, required shorter periods to achieve the light-off temperature. Alumina supported Pt catalysts may be used. The performance of the catalyst element may be enhanced by forming the element in such a manner as to provide portions thereof having a greater length of exposed edge than other portions of said body whereby these portions tend to heat more quickly to a higher temperature than other portions of the body when exposed to an igniting flame. This can be achieved by forming these portions so as to have low thermal mass and lower thermal conduction rate as described hereinbelow.

Figure 6B:
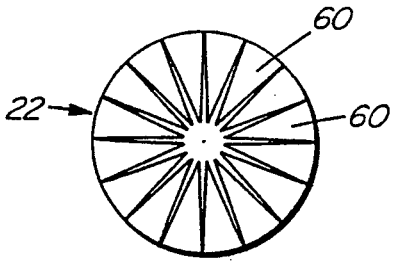
FIGS. 6*a* and 6*b* are longitudinal cross-sectional and top views, respectively, of a catalytic element according to an alternative embodiment of the present invention.
Figure 6A:
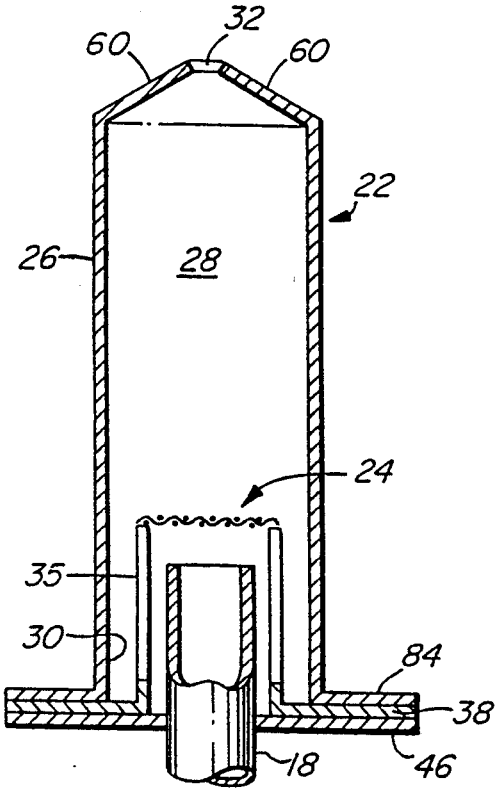

The embodiment of FIGS. 6*a* and 6*b* produces an effect that would normally accompany a catalytic structure with extremely low thermal mass. In this embodiment, the top edge of the catalyst screen is cut in a zig-zag fashion to form a plurality of triangular projections or tips 60 which are bent inwardly to obstruct or retard the outwardly flow of gases. In this manner, it will be seen that the length of exposed edges of the projections is substantially larger than that of the exposed edge of a plain circular opening. Thus, when an explosion occurs, the tips absorb heat more quickly than the main body portions of the catalyst module and accordingly begin to oxidize the combustible gas more quickly. The heat is then conducted to the other parts of the module which then begin to oxidize the combustible gas. It has been found that only when a catalyst displayed poor activity was a flame observed in the combustion chamber of this embodiment. In most cases, catalytic oxidation commences from the moment of the explosion. This embodiment is particularly effective in cases where the spark is generated below the retainer.

Figure 7B:
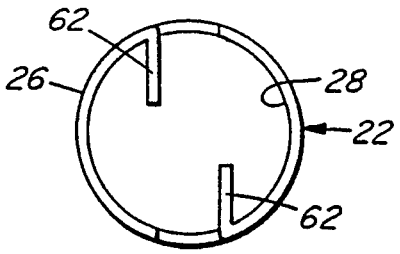
FIGS. 7*a* and 7*b* are longitudinal cross-sectional and top views, respectively, of a catalytic element according to a further alternative embodiment of the present invention.
Figure 7A:
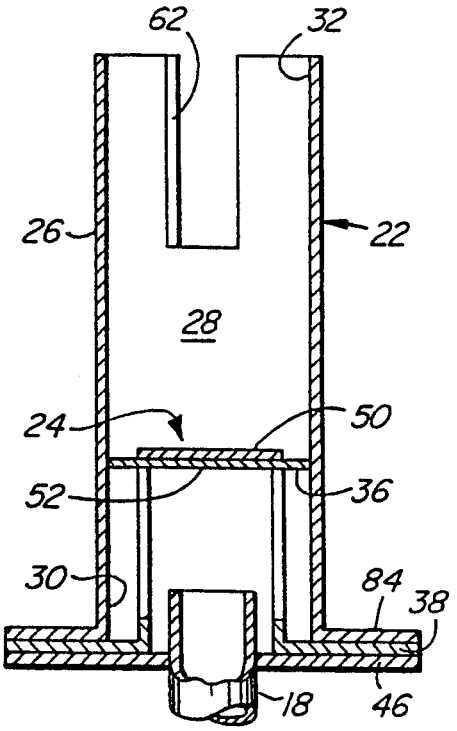

With reference to FIGS. 7*a* and 7*b*, two flaps 62 are formed on diametrically opposed sides of the top end of the catalyst module and positioned in the combustion chamber in the gas flow path. Again, the edges of the flaps provide surface area which would not otherwise be available. Oxidation commences at the top corner of the flaps due to greater temperatures and progresses to other parts of the module. As noted above for the embodiment of FIGS. 6*a* and 6*b*, unless the catalyst was not very active, no flame will form on the distributor after the initial explosion and, if a flame is observed on the distributor, indicating a high light-off temperature, it should last for only a very short time.

Figure 8B:
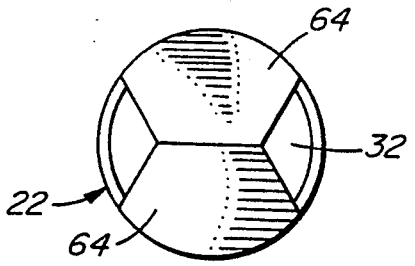
FIGS. 8*a* and 8*b* are longitudinal cross-sectional and top views, respectively, of a catalytic element according to still a further alternative embodiment of the present invention.
Figure 9:
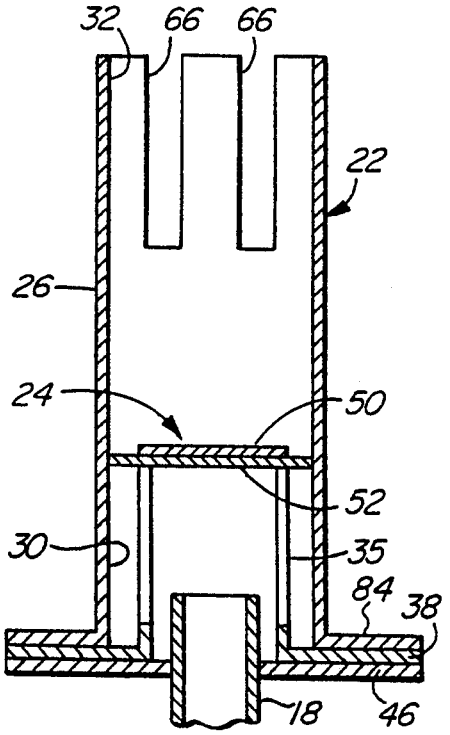
FIG. 9 is longitudinal cross-sectional view of a catalytic element according to a further alternative embodiment of the present invention.
Figure 8A:
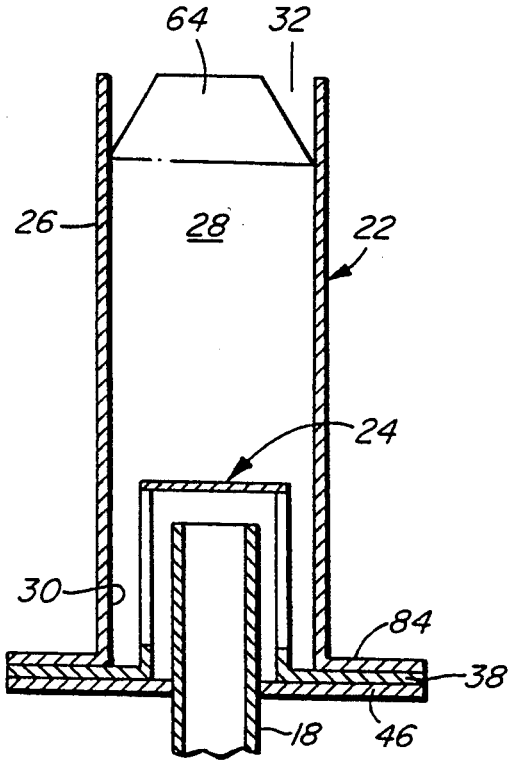

FIGS. 8*a* and 8*b* illustrate another embodiment in which two of the four flaps 64 are spot welded together along their top edges. The width of the spot welded flaps may be cut narrower so as to provide larger openings at the top for the gases to escape. FIG. 9 illustrates a simple design in which a plurality of axial slits 66 are formed in the upper end of the module.

Figure 10:
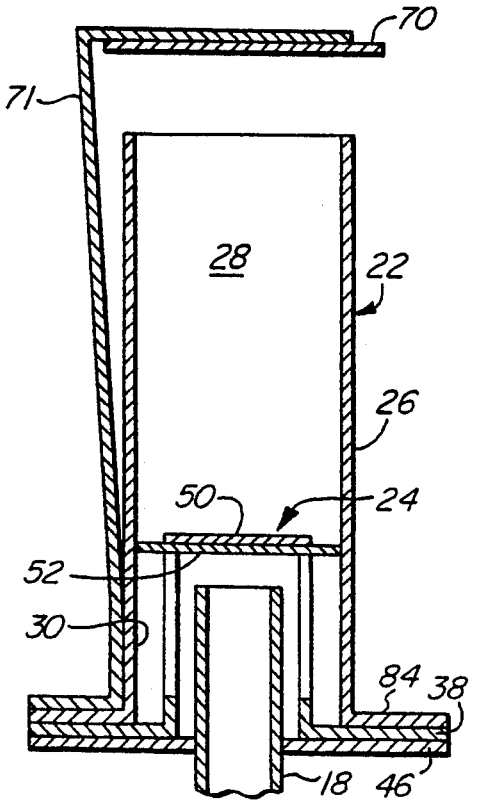
FIGS. 10, 11 and 12 are longitudinal cross-sectional view of a catalytic element according to further alternative embodiments of the present invention.

When the spark for the explosion is provided below the retainer, it has been found that the reliability of ignition could be increased by providing a deflector 70 above the catalyst cylinder as shown in FIG. 10. The deflector may be secured to one end of a thin stainless steel arm 71 which in turn is secured to element 22. The deflector may be in the form of a solid disc placed a short distance above the top end of the body 26 so that gas exiting the body through the top end is deflected radially outwardly of the burner and downwardly toward the handle end of heating chamber 16. This ensures that the mixture of gases is present below the retainer where the spark is generated. A disc of fine mesh screen material may also be used for this purpose. A catalyst screen formed into a disc and employed as a deflector can also be used with the concomitant advantage of providing further oxidation of any combustible gas present in the impinging stream when the operating temperature is reached.

Figure 11:
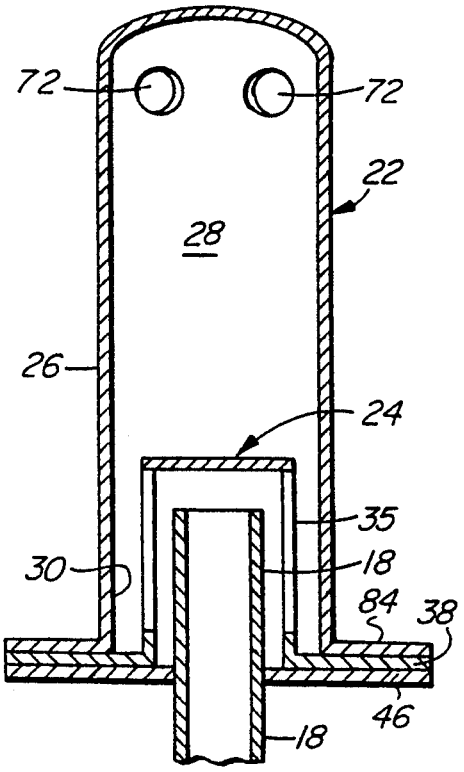
Figure 12:
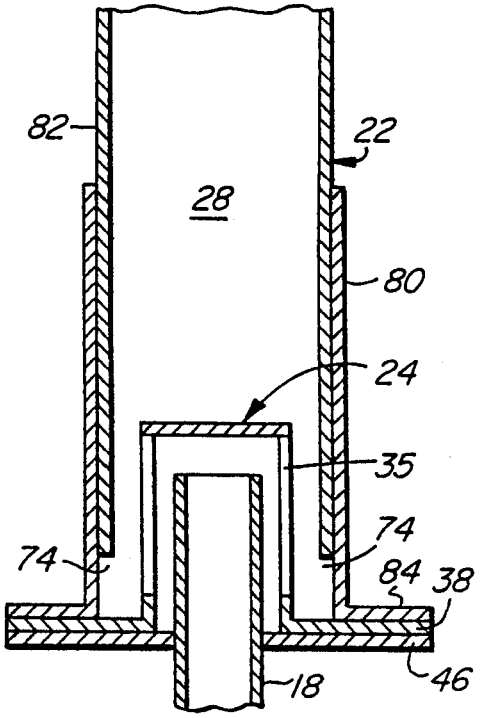

Other methods used to facilitate the flow of gases to the area of the retainer include providing relatively large perforations 72 (FIG. 11) on the catalyst screen, providing a circumferential opening 74 at the base of the module as shown in FIG. 12, cutting two large rectangular openings at the bottom, cutting openings on the catalyst screen in various shapes and coating the screen lightly so that the gas mixture can escape through the mesh to the outside. As illustrated in FIG. 12, a catalyst module formed with coarser screen 80 at the bottom and finer screen 82 at the top, both coated with catalytic material, also perform well. The catalyst screen could also be corrugated. All of the above described embodiments could be formed in the manner shown in FIG. 12 where the catalyst screen is pushed inside an outer basket 80 which serves as a container for the catalyst.

For most of the embodiments, the catalyst screen may be heavily coated with alumina and then platinized. The coating may be such that there is no substantial gas flow through the catalyst screen.

One method of forming an alumina supported catalyst preparation comprises the steps of degreasing modules with Fasolv (trade mark), rinsing and then oxidizing the modules at 450° C. for 1 hour. A 20–25% alumina washcoat solution is prepared by diluting the alumina washcoat (Hi Tech Ceramics, 40% alumina slurry) 1:1 with water. The modules are dipped in the washcoat slurry for a few seconds, removed and scraped of any heavy accumulation of alumina. After air drying, the modules are calcined at 450° C. for 1 hour. Platinization is accomplished with an ethanol solution of chloroplatinic acid (13 gm of chloroplatinic acid in 100 mL of alcohol) by dipping the modules in it, air drying, calcining in He at 250° C. for 1.5 hours and then reducing in hydrogen at 250° C. for 2 hours.

The stainless steel catalyst screen may have a diameter of 9 mm diameter and a length of 25 mm. Its lower or inlet end may be spotwelded to the catalyst ring 84 similar to annular flange 38, described earlier and illustrated in cross-section in FIG. 2.

It will be understood that various modifications and alterations may be made without departing from the spirit of the invention. The burner of the present invention may be used in heat producing devices such as soldering irons, camp heaters, as well as curling irons as described hereinabove. The invention also contemplates catalyst support materials other than alumina described above.

The embodiments of the invention in which an exclusive property or privilege is claimed are defined as follows:

1. A catalyst module for use in a catalytic combustion device, said module comprising:

a self-supporting tubular body for carrying a catalyst coating, said coating including a porous catalyst support material having a high surface area applied to said body and a catalyst applied to said catalyst support material, said body being formed of a fine mesh metallic screen having a passage extending therethrough and defining a catalytic combustion chamber and having an axial inlet opening at one end of said chamber for receiving a gaseous fuel and an axial outlet opening at an opposite end of said chamber for discharging products of combustion from said chamber, said outer opening having cut ends of wires exposed from said catalyst coating; and a fine mesh, metallic fuel distributing screen element disposed within and extending across said chamber.

2. A catalyst module as defined in claim 1, further including support means secured to said inlet end of said body for mounting said body onto a gaseous fuel discharge tube of a catalytic combustion device, said support means including an annular flange portion and a tubular neck portion secured to said inlet end of said body.

3. A catalyst module as defined in claim 1, further including means for releasing gaseous fuel from said chamber to the exterior of said body.

4. A catalyst module as defined in claim 3, said means for releasing gaseous fuel including relatively large perforations in said body.

5. A catalyst module as defined in claim 3, said means for releasing gaseous fuel including relatively large circumferential openings formed in the said body adjacent said outlet end of said body.

6. A catalyst module as defined in claim 2, said support means further including a relatively coarse tubular screen secured to and extending axially from said neck portion, said relatively coarse mesh tubular screen being adapted to receive said body in snug fit relation.

7. A catalyst module as defined in claim 1 wherein said inlet end of said body being axially spaced from a neck portion of a support means for mounting said body onto a gaseous fuel discharge tube of said catalytic combustion device, and said module further comprising a relatively large opening between said chamber and the exterior of said body for permitting flow of a controlled amount of gaseous fuel from said chamber to the exterior of said body.

8. A catalyst module as defined in claim 1, said distributing element comprising a pair of fine mesh screens secured together in face-to-face relation.

9. A catalyst module as defined in claim 1, said distributing element having a coating of catalytic material applied thereto, said coating of catalytic material comprising a catalyst and a catalyst support for supporting said catalyst.

10. A catalyst module as defined in claim 1, said fine mesh screen of said distributing element having a U.S. mesh screen size in the range of 100 to 325.

11. A catalyst module for use in a catalytic combustion device, said module comprising:

a catalytic combustion element comprising a self-supporting tubular body having a coating of catalytic material applied thereto, said body formed of a fine mesh, metallic screen in the form of woven wires having a passage extending therethrough and defining a catalytic combustion chamber, an axial inlet opening at one end of said chamber for receiving a gaseous fuel and an axial outlet opening at an opposite end of said chamber for discharging products of combustion from said chamber, said coating of catalytic material comprising a catalyst and a catalyst support having a high surface area said axial outlet having exposed cut ends of said wires; and a fuel distributing element formed of a fine mesh, metallic fuel screen, said distributing element being disposed within and extending across said chamber so as to produce a concentrated explosion near said outlet when said module is exposed to an igniting flame.

12. A catalyst module for use in a catalytic combustion device, said module comprising:

a catalytic combustion element comprising a self-supporting tubular body having a coating of catalytic material applied thereto;

said body formed of a mesh stainless steel screen in the form of woven wires, having a U.S. mesh screen size in the range of 100 to 325, said body having a passage extending therethrough and defining a catalytic combustion chamber and having an axial inlet opening at one end of said chamber for receiving a gaseous fuel and an axial outlet opening at an opposite end of said chamber for discharging products of combustion from said chamber;

said coating of catalytic material comprising a catalyst and a catalyst support for supporting said catalyst, said catalyst being platinum, said catalyst support being a porous material selected from the group consisting of alumina and silica to provide high surface area for supporting said catalyst thereon, and being held on and in the interstices between said wires of said stainless steel screen of said body;

said combustion element outlet having an end cut means for exposing the ends of said coated wires so that, when said module is exposed to an igniting flame, said exposed ends of said coated wires tend to heat quickly to a higher temperature with the result that catalyst adjacent to said exposed ends of said wires is activated quickly; and a fuel distributing element formed of a fine mesh, stainless steel screen in the form of woven wires having a U.S. mesh screen size in the range of 100 to 325, said distributing element being disposed within and extending across said chamber, spaced from an outlet of a gaseous fuel discharge tube of a catalytic combustion device, and dimensioned to provide an annular clearance between the inner surface of said body and the circumference of said distributing element, said fine mesh having pore means for allowing some of said fuel to pass therethrough and some of said fuel to pass through said annular clearance so as to produce a concentrated explosion near said outlet when said module is exposed to an igniting flame.

* * * * *